US011095055B2

(12) United States Patent
Jaworski et al.

(10) Patent No.: US 11,095,055 B2
(45) Date of Patent: Aug. 17, 2021

(54) TERMINAL BLOCK AND TERMINAL BLOCK ASSEMBLY FOR MEDIUM TO HIGH VOLTAGE APPLICATIONS

(71) Applicant: Raytheon Company, Waltham, MA (US)

(72) Inventors: Bradley S. Jaworski, Bedford, MA (US); Peter D. Morico, North Grafton, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 16/742,822

(22) Filed: Jan. 14, 2020

(65) Prior Publication Data

US 2021/0226357 A1 Jul. 22, 2021

Related U.S. Application Data

(60) Provisional application No. 62/952,021, filed on Dec. 20, 2019.

(51) Int. Cl.

| | |
|---|---|
| ***H01R 9/24*** | (2006.01) |
| ***H01R 13/514*** | (2006.01) |
| ***H01R 13/58*** | (2006.01) |

(52) U.S. Cl.

CPC ..... *H01R 9/24* (2013.01); *H01R 13/514* (2013.01); *H01R 13/5829* (2013.01)

(58) Field of Classification Search

CPC ..... H01R 9/24; H01R 13/514; H01R 13/5829
USPC ..... 439/709
See application file for complete search history.

(56) References Cited

U.S. PATENT DOCUMENTS 2,766,436 A * 10/1956 Luebking ..... H01R 9/24 439/722
3,007,131 A * 10/1961 Dahlgren ..... H01R 12/59 439/492
3,629,809 A * 12/1971 Tillmann ..... H01R 12/716 439/629
5,836,791 A * 11/1998 Waas ..... H01R 4/2433 439/709

(Continued)

FOREIGN PATENT DOCUMENTS

EP 0017330 B1 4/1983

OTHER PUBLICATIONS

Automationdirect, PB1043, https://www.automationdirect.com/adc/shopping/catalog/power_products_(electrical)/power_distribution_blocks/open_style,_ul_recognized,_175a-760a_(pb_series)/pb1043, retrieved on Jun. 18, 2019, 3 pages, AutomationDirect.com, Cumming, GA.

*Primary Examiner* — Harshad C Patel

(57) ABSTRACT

Systems and method are described for a terminal block that can include an insulating block that is composed of an electrically insulating material. The insulating structure can have a first via extending between a first and second opening in the insulating block. A second via can extend between a third and fourth opening in the insulating block. A distance between the first and second openings may be less than a distance between the third and fourth openings. A first electrical conducting element can extend between the first and second openings. A second electrical conducting element can extend between the third and fourth openings. The first and second electrical conducting elements can be separated from one another by a portion of the insulating block.

29 Claims, 14 Drawing Sheets

(56) References Cited

U.S. PATENT DOCUMENTS

| | | | | |
|---|---|---|---|---|
| 6,425,779 | B1 * | 7/2002 | O'Brien, II | H01R 35/025 439/162 |
| 7,247,045 | B1 * | 7/2007 | Arellano | H01R 4/2408 439/416 |
| 7,497,711 | B2 * | 3/2009 | Gherardini | H01R 25/162 174/72 B |
| 7,862,362 | B2 * | 1/2011 | Koehler | G01R 1/0466 439/331 |
| 8,742,636 | B2 | 6/2014 | Kitagawa et al. | |
| 8,933,338 | B2 | 1/2015 | Ikeda et al. | |
| 9,071,101 | B2 | 6/2015 | Patel et al. | |
| 10,553,983 | B2 * | 2/2020 | Mito | H01R 13/514 |
| 2005/0233648 | A1 * | 10/2005 | Siracki | H01R 9/24 439/721 |
| 2006/0172562 | A1 * | 8/2006 | Weidner | H01R 24/50 439/63 |
| 2011/0217857 | A1 * | 9/2011 | Truskett | H04Q 1/021 439/95 |
| 2013/0048477 | A1 * | 2/2013 | Rahn | H02B 1/0565 200/50.24 |
| 2018/0090262 | A1 | 3/2018 | Tsukada et al. | |
| 2018/0337470 | A1 | 11/2018 | Cerka et al. | |
| 2018/0337471 | A1 | 11/2018 | Yamamoto | |

* cited by examiner

500

TERMINAL BLOCK AND TERMINAL BLOCK ASSEMBLY FOR MEDIUM TO HIGH VOLTAGE APPLICATIONS

RELATED APPLICATION

This application claims the benefit of U.S. Provisional Application Ser. No. 62/952,021, filed Dec. 20, 2019, and entitled, "Terminal Block and Terminal Block Assembly for Medium to High Voltage Applications" which is incorporated by reference in its entirety herein.

GOVERNMENT LICENSE RIGHTS

This invention was made with government support under N00024-12-C-4223 awarded by the Department of Defense. The government has certain rights in the invention.

BACKGROUND

Electronic devices may have one or more components that need to be connected to one another. Electrical connectors are used to connect an electrically conductive component, such as a wire, to another electrically conductive component. A terminal block is an example of one type of an electrical connector that provides a convenient means of connecting individual electrical wires without a splice or without physically joining the ends. One type of terminal block accepts wires that are prepared only by stripping a short length of insulation from the end of the wire. The bare end of the wires that are stripped of insulation may allow for inadequate electrical creepage and clearance distance between two wires connected to the terminal block. This inadequate distance has traditionally made terminal blocks unsuitable for medium to high voltage connections.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1A:
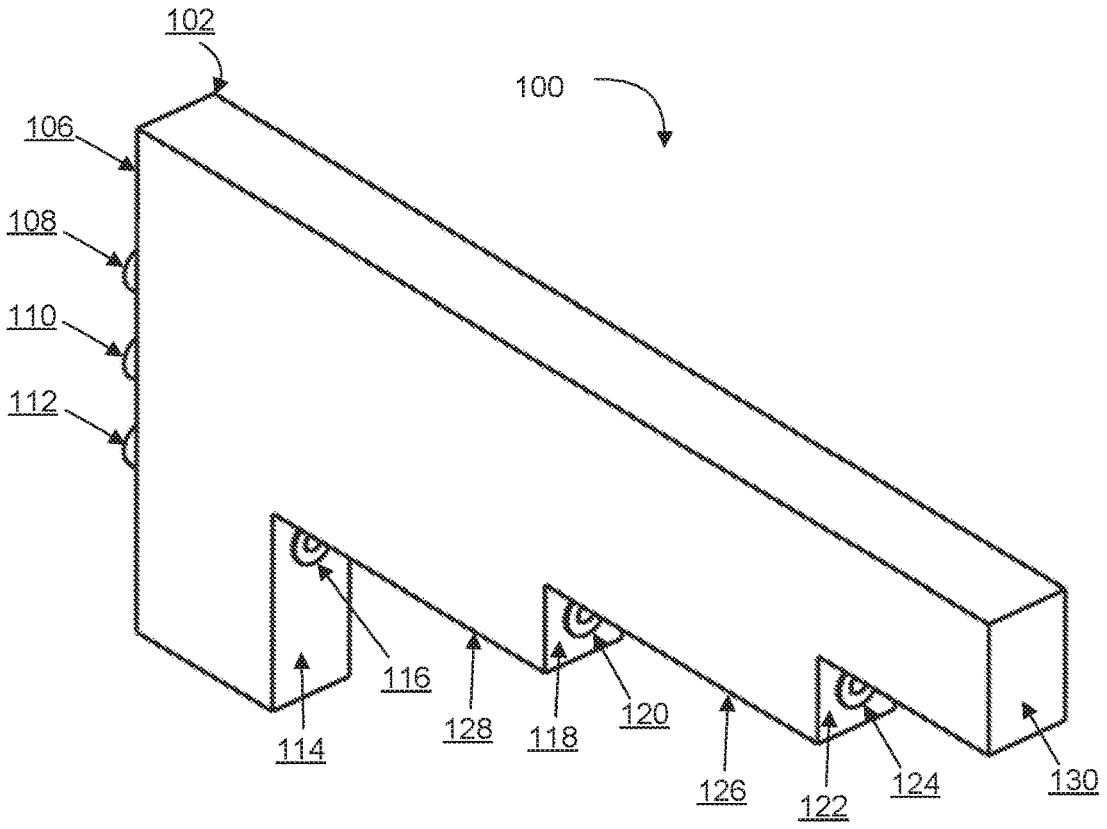
FIG. 1A illustrates an isometric view of a terminal block according to an example of the present technology.
Figure 1B:
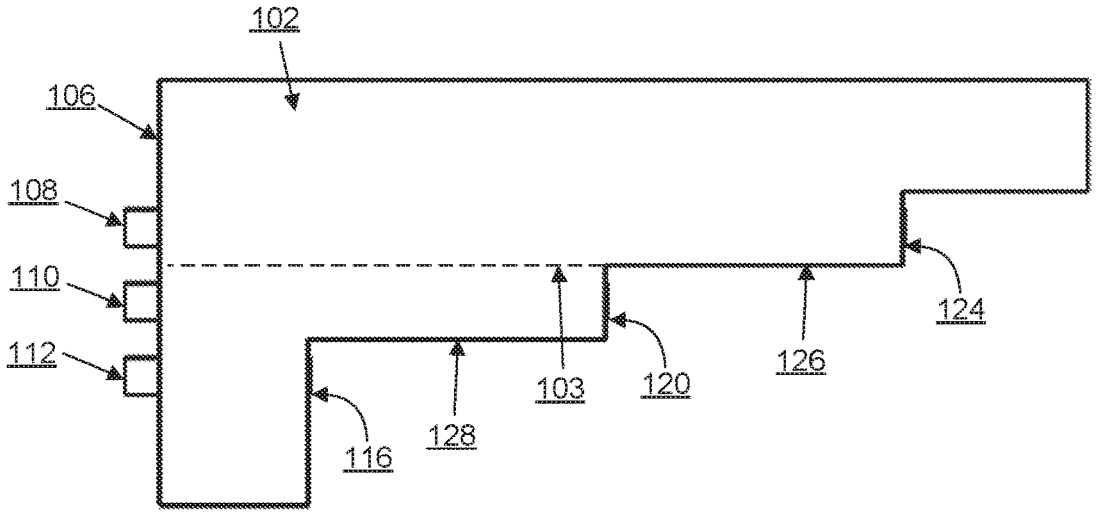
FIG. 1B illustrates a side view of the terminal block of FIG. 1A.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context. In addition, adjacent can refer to two like elements that are near or close to one another, with some other type of device or object disposed between them.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

Examples of the present technology provide for a terminal block that is suitable for use with medium to high voltage connections where at least two of the connection points on the terminal block are open, bare, or uninsulated connection points. Medium voltage may be defined as 1 kilo volts (kV)

direct current (DC) or alternating current (AC) to 35 kV. High voltage may be defined as 35 kV to 230 kV.

Prior solutions for terminal blocks used for medium to high voltage connections that have uninsulated connection points are not compact and do not separate the connection points with creepage and clearance so that sufficient distance and air can be used to avoid electrical connections made through the air or across a surface such as an electrical arc, leakage current tracking, corona, electron tunneling, and other unintended breakdown mechanisms. An industrially accepted test measure of achieving adequate creepage and clearance distances is known as leakage current or charge. Creepage and clearance distances can be measured using Dielectric Withstanding Voltage (DWV) and/or Partial Discharge (PD) test techniques and equipment. DVW results in a leakage current measurement the units of which are Amperes (usually nano or micro amperes) and PD results in a charge measurement of Coulombs (usually pico-coulombs). In both cases a lower value indicates a better insulation system. On the other hand, the terminal block of the present technology is a compact design that is formed to provide adequate electrical creepage and clearance distance between two bare connection points. This can be accomplished by forming the terminal block with a stair step pattern, such that the two bare connection points are positioned on different surfaces from one another and further separated by a third surface in the stair step pattern. Positioning the two bare connections on separate surfaces that are separated by a third surface of the terminal block can increase the creepage distance along the surfaces between the two bare connection points, and can therefore eliminate or at least decrease the potential for inadequate creepage distance. The bare connections can be positioned on the stair step pattern, such that the bare connections are oriented in the same direction, but do not have line of sight to one another due to the different surfaces of the stair step pattern, thereby creating adequate clearance distance. By removing line of sight between the two bare connections, the clearance distance can be increased and the potential for an electrical arc decreased. Creepage distance is defined to be the shortest distance along the surface of a solid insulating material between two conductive parts. Clearance denotes the shortest distance between two conductive parts through the air, vacuum, or other gas surrounding the terminal block. Increasing the creepage distance and the clearance distance between two bare connections on the terminal block increases the amount of voltage that the terminal block can stand-off or tolerate without a significant risk of electrical breakdown which can result in an electrical arc between the two, or more, bare connections.

In one example, a terminal block can include an insulating block that is composed of an electrically insulating material. The insulating block can have a first via extending between a first opening and second opening in the insulating block. A second via can extend between a third opening and fourth opening in the insulating block. A distance between the first and second openings may be less than a distance between the third and fourth openings. A first electrical conducting element can extend between the first and second openings. A second electrical conducting element can extend between the third and fourth openings. The first and second electrical conducting elements can be separated from one another by a portion of the insulating block. In this example, the distance between the first and second openings may be less than a distance between the third and fourth openings to allow for a distance separation between the second opening and the fourth opening. This distance may be along a surface of the insulating block designed to increase electrical creepage distance between the first and second electrical conducting elements that may be uninsulated at the second and fourth openings. The surface of the insulating block between the second and fourth openings may be formed in a non-linear pattern that is not smooth. The surface of the insulating block between the second and fourth openings may be formed in a linear pattern that is substantially smooth. The non-linear pattern can create more distance between the second and fourth opening that further reduces the chance of electrical breakdown. The insulating block may be separated from a second insulating block with a removable partition that electrically insulates electrical conducting elements in the insulating block from electrical conducting elements in the second insulating block and obviates any lines of sight (e.g. clearance) between conductive elements of differing potentials (e.g. voltage).

In one example, a terminal block can include an insulating block composed of an electrically insulating material. The insulating block can include a rear surface, a first surface located at a first spatial position from the rear surface, and a second surface located at a second spatial position from the rear surface, wherein the second spatial position is located at a greater distance from the rear surface than a distance of the first spatial position from the rear surface. A third surface can extend between the first surface and the second surface. A first electrical conducting element can extend between the rear surface and the first surface. A second electrical conducting element can extend between the rear surface and the second surface. The first and second electrical conducting elements can be separated from one another by a portion of the insulating block. The third surface of the insulating block can be used to prevent creepage between first and second electrical conducting elements that may have uninsulated connections. In a further example, the first and second surfaces may be substantially parallel to one another and the rear surface and the third surface may be substantially perpendicular to the first and second surfaces.

In one example, a terminal block assembly can include a chassis and a plurality of terminal blocks releasably supported within the chassis. Each of the plurality of terminal blocks can include an insulating block composed of an electrically insulating material. The insulating block can include a rear surface, a first surface located at a first spatial position from the rear surface, and a second surface located at a second spatial position from the rear surface, wherein the second spatial position is located at a greater distance from the rear surface than a distance of the first spatial position from the rear surface. A third surface can extend between the first surface and the second surface. A first electrical conducting element can extend between the rear surface and the first surface. A second electrical conducting element can extend between the rear surface and the second surface. The first and second electrical conducting elements can be separated from one another by a portion of the insulating block. The terminal block assembly can further include a plurality of removable partition barriers that electrically insulate the plurality of terminal blocks from one another, each being supported by the chassis and disposed between adjacent terminal blocks. The third surface of the insulating block can be used to increase creepage distance between first and second electrical conducting elements that may have uninsulated connections. In a further example, the first and second surfaces may be substantially parallel to one another and the rear surface and the third surface may be substantially perpendicular to the first and second surfaces.

In one example, a method for configuring a terminal block, can include forming an insulating block composed of an electrically insulating material. The insulating block can be formed with a rear surface, a first surface located at a first spatial position from the rear surface, and a second surface located at a second spatial position from the rear surface, where the second spatial position is located at a greater distance from the rear surface than a distance of the first spatial position from the rear surface. A third surface can be formed to extend between the first surface and the second surface. The method can further include pressing a first electrical conducting element between the rear surface and the first surface. The method can further include pressing a second electrical conducting element extending between the rear surface and the second surface. The first and second electrical conducting elements can be separated from one another by a portion of the insulating block. The third surface may be formed to prevent electrical creepage between first and second electrical conducting elements that may have uninsulated connections.

To further describe the present technology, examples are now provided with reference to the figures. With reference to FIGS. 1A-1F the present disclosure sets forth a terminal block 100 in accordance with one example. The terminal block 100 may be used to connect two electric wires. For example, an electronic device may be required to connect to a power source. Wires from the power source and wires from the electronic device may be connected using the terminal block 100. The terminal block 100 may be suitable to allow pass through of medium to high voltages. Different dimensions, shapes, and gauges of electrical conducting elements of the terminal block 100 allow for different tolerances of clearance and creepage. For example, increasing the distance of surface area between two uninsulated electrical connections supported in the terminal block 100 increases the creepage distance which may decrease the risk of electrical leakage current and subsequent arc formation from occurring. Similarly, increasing the air gap between two uninsulated electrical connections in the terminal block 100 can decrease the risk of electrical leakage current and and subsequent arc formation between the two, or more, connections. Additionally, positioning uninsulated electrical connections in the terminal block 100 so that the uninsulated electrical connections do not have line of sight to one another can also increase the clearance and decrease the risk of electrical leakage current and the subsequent formation of an electrical arc.

The terminal block 100 may be designed with principles of the present technology to allow pass through of medium voltage without significant risk of electrical leakage current or an electrical arc forming. In one example, the terminal block 100 may be designed with principles of the present technology to allow pass through of high voltage without significant risk of electrical creepage or an electrical arc forming.

The terminal block 100 can include an insulating block 102. The insulating block 102 can be composed of or formed from one or more materials that are electrically insulating. For example, electrical insulating materials can include, but are not limited to, plastics, rubbers, ceramics, and others, or combinations of these, as will be appreciated by those skilled in the art. Specific examples of insulating materials can include ceramic (alumina) Delrin, GPO3, FR4, Phenolic, Bakelite, Polyvinyl chloride (PVC), Formex, Glastherm, and G7/9/10/11. The insulating material for the insulating block 102 can be configured or selected to insulate against medium to high voltages.

The insulating block 102 can be formed with a rear surface 106. A first surface 122 may be formed at a first spatial position from the rear surface 106. A second surface 118 may be formed at a second spatial position from the rear surface 106. A third surface 126 may be formed extending between the first surface 122 and the second surface 118. A fourth surface 114 may be formed at a third spatial position from the rear surface 106. A sixth surface 128 may be formed between the second surface 118 and the fourth surface 114. A seventh surface 130 may be formed at a fourth spatial position from the rear surface 106. As shown, the insulating block 102 is formed with the rear surface 106, the first surface 122, the second surface 118, the fourth surface 114, and the seventh surface 130 being oriented parallel or substantially parallel to one another with the third surface 126 and the sixth surface 128 being oriented transverse (e.g., perpendicular or substantially perpendicular) to the rear surface 106. Such a shape may be described as a stair step design. It should be appreciated that the insulating block can comprise other suitable shapes or configurations in conjunction with the present technology to reduce creepage and clearance. For example, a shape or configuration of the insulating block 102 may not have straight lines with perpendicular corners and instead may have curved surfaces with rounded corners or a combination thereof (see FIG. 3). In one example, the rear surface 106 of the insulating block 102 can also be formed in a stair step pattern to stagger the positioning of the electrical conducting elements (see FIG. 4).

The rear surface 106 may be formed with openings to allow electrical conducting elements to pass through the rear surface 106. For example, a first opening may be formed in the rear surface 106 to allow a first electrical conducting element 108 to pass through the insulating block 102 with the first electrical conducting element 108 extending through the first opening and a second opening 124 in the first surface 122. A second electrical conducting element 110 can pass through the insulating block 102 with the second electrical conducting element 110 extending through a third opening in the rear surface 106 to a fourth opening 120 in the second surface 118. A third electrical conducting element 112 can pass through the insulating block 102 with the third electrical conducting element 112 extending through a fifth opening in the rear surface 106 to a sixth opening 116 in the fourth surface 114. The first electrical conducting element 108, the second electrical conducting element 110, and the third electrical conducting element 112 are depicted as being supported in the insulating block 102 in a parallel or substantially parallel arrangement relative to one another. However, the first electrical conducting element 108, the second electrical conducting element 110, and third electrical conducting element 112 can be supported in other non-parallel orientations or arrangements relative to one another as they pass through the insulating block 102. The first electrical conducting element 108, the second electrical conducting element 110, and third electrical conducting element 112 can each be separated from one another by a distance and a portion of the insulating block 102 sufficient to insulate electrical currents passing through the electrical conducting elements. The electrical conducting elements can be composed of any suitable electrically conductive material such as copper, aluminum, gold, silver, and others as will be apparent to those skilled in the art. The electrical conducting elements can be formed, extruded, machined, cast, 3D printed, grown, sputtered, plated, etc, into any suitable shape such as a rod, bar, wire, a collection of wires or bars, etc.

The third surface 126 and the sixth surface 128 can be designed to reduce leakage currents between the connection points of the electrical conducting elements that are uninsulated. For example, the first electrical conducting element 108 can have an uninsulated connection at the second opening 124 and the second electrical conducting element 110 can have an uninsulated connection at the fourth opening 120. The third surface 126 can be designed with a distance to prevent creepage between the uninsulated connections at the second opening 124 and the fourth opening 120. By increasing the distance along the surface or surfaces between two uninsulated electrical connections of the insulated block 102, the potential for electrical creepage to occur can be decreased. By forming the insulated block 102 to include the third surface 126, the distance between the second opening 124 and the fourth opening 120 is increased as compared to an example where the second opening 124 and the fourth opening 120 are on the same surface. By increasing the length of the third surface 126 the distance between the second opening 124 and the fourth opening 120 is increased and the potential for electrical creepage can be decreased. The insulated block 102 may be formed to create a creepage distance between two uninsulated electrical connections with any distance. In one example, the creepage distance created by the third surface 126 and/or the sixth surface 128 can be 40 mm to 80 mm (1.6-3.2 inches). However, this is not intended to be limiting in any way as other creepage distances are contemplated, and will be dependent upon the desired or intended application and pre-determined performance requirements or parameters.

The orientation of the openings in the terminal block 100 and connections of the electrical conducting elements can be designed to reduce clearance between two uninsulated connections. For example, the first electrical conducting element 108 can have an uninsulated connection at the second opening 124 and the second electrical conducting element 110 can have an uninsulated connection at the fourth opening 120. These uninsulated connections are depicted in FIG. 1A as being oriented so that the uninsulated connections do not have line of sight to one another. This lack of line of sight reduces clearance that can cause an electrical connection through the air between two uninsulated connections. The clearance distance can be any distance. In one example, the clearance distance between the second opening 124 and the fourth opening 120 can be 25 mm to 35 mm (1.0-1.4 inches). However, this is not intended to be limiting in any way as other distances are contemplated.

The terminal block 100 is depicted as have three electrical conducting elements. It should be appreciated that that the terminal block 100 may have one, two, four, five or any number of electrical conducting elements. In one example, a terminal block 100 may have only two electrical conducting elements. For example, a terminal block 100 may only have components (i.e., surfaces) depicted below a dotted line 103 of FIG. 1B. In one example, the terminal block 100 can comprise two electrical conducting elements where one electrical conducting element is electrically positive and a second electrical conducting element is electrically negative. In one example, the first electrical conducting element 108 can be electrically positive, the second electrical conducting element 110 can be electrically negative, and the third electrical conducting element 112 can comprise a shield.

A width of the terminal block 100 and/or the insulating block 102 can be any width suitable for the intended application.

The third surface 126 and the sixth surface 128 depict surfaces of the terminal block 100 that are designed to reduce electrical creepage between uninsulated connections of electrical conducting elements.

Figure 1C:
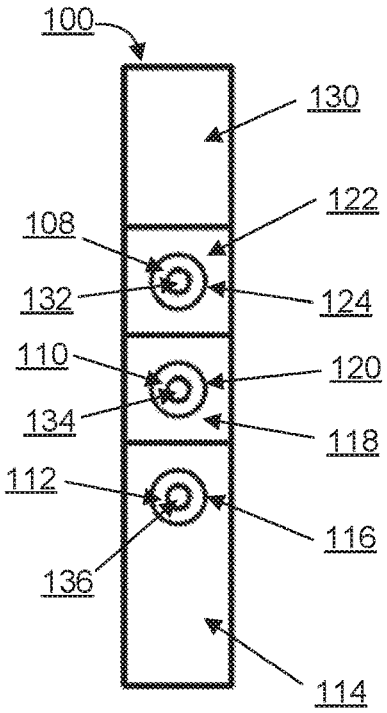
FIG. 1C illustrates a front view of the terminal block of FIG. 1A.
Figure 1D:
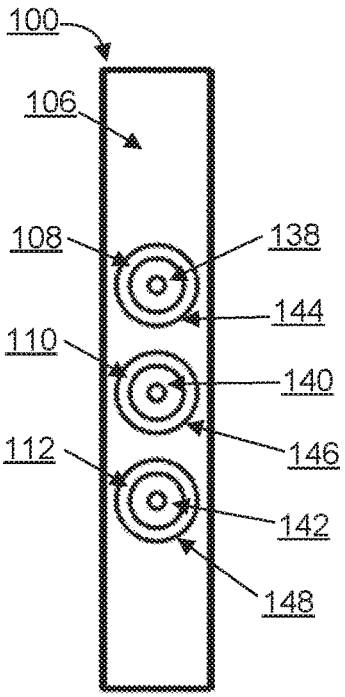
FIG. 1D illustrates a back or rear view of the terminal block of FIG. 1A.
Figure 1E:
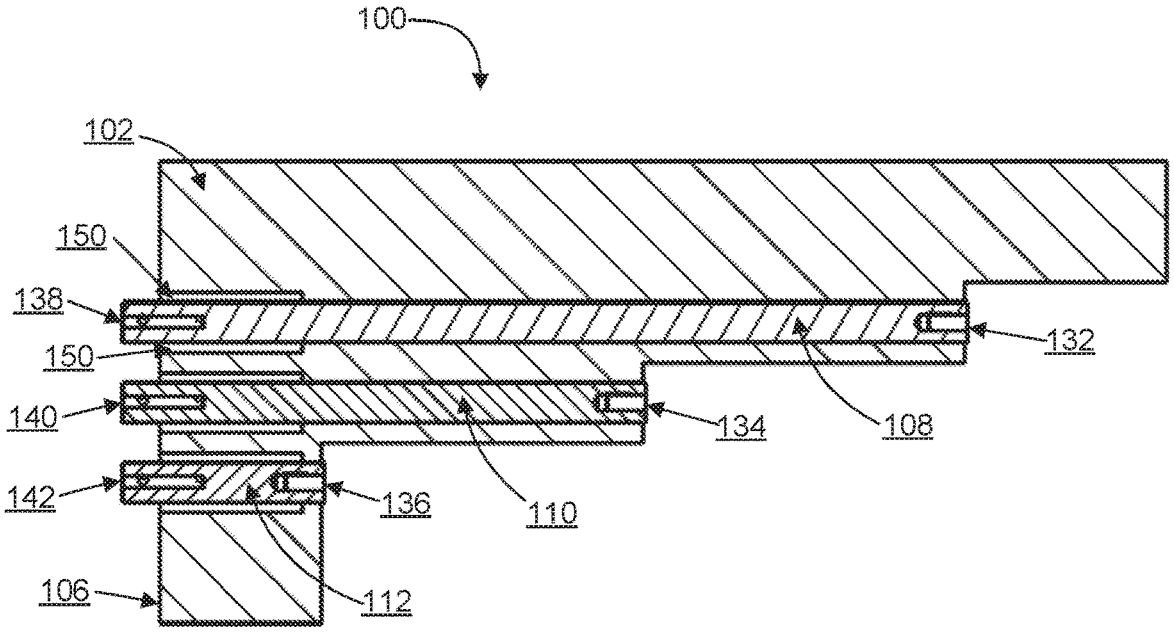
FIG. 1E illustrates a cross-sectional side view of the terminal block of FIG. 1A.
Figure 1F:
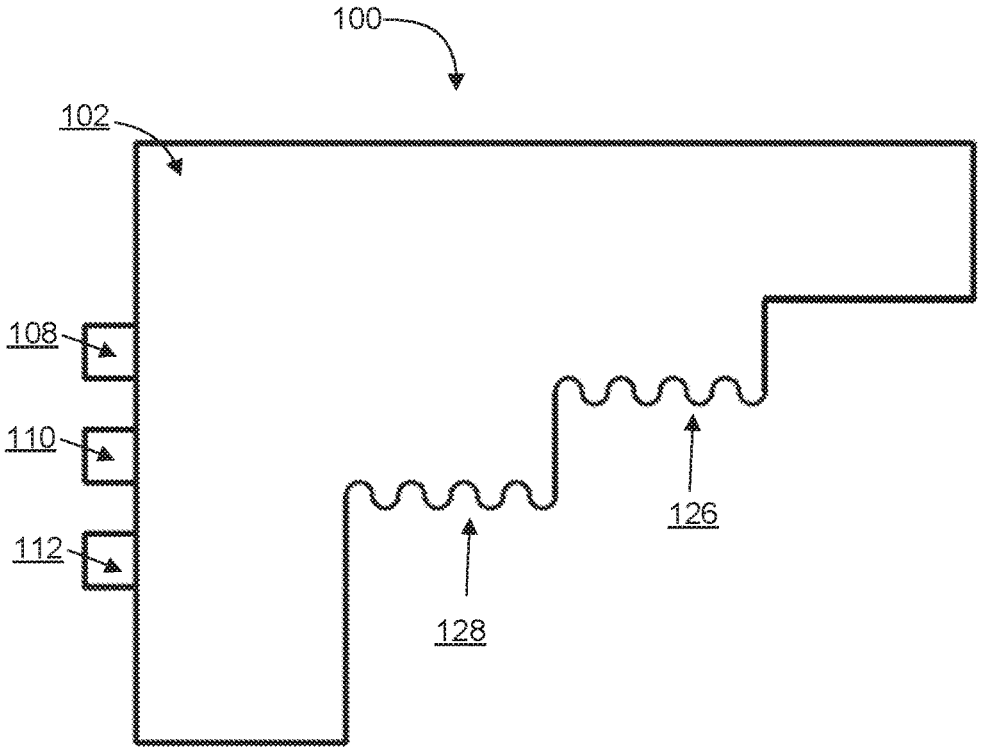
FIG. 1F illustrates a side view of the terminal block of FIG. 1A, with the terminal block having a non-linear surface pattern that is not smooth formed about two of its stepped surfaces.

The first electrical conducting element 108, the second electrical conducting element 110, and the third electrical conducting element 112 can include connectors 132, 134, and 136, respectively (see particularly FIG. 1C). The connectors 132, 134, and 136 can be electrical connectors that are part of or attached to the electrical conducting elements. In one example, the connectors 132, 134, and 136 can be uninsulated connections. The uninsulated connections allow wires to be quickly connected and disconnected from the connectors 132, 134, and 136. In one example, the connectors 132, 134, and 136 can be lugged connectors, ring lug connectors, pin connectors, socket connects, or wire terminations that can use threads, sockets, pins, posts, or other interface types. In one example, the connectors 132, 134, and 136 can be insulated after wires have been connected.

The first electrical conducting element 108, the second electrical conducting element 110, and the third electrical conducting element 112 can further comprise connectors 138, 140, and 142, respectively. The connectors 138, 140, and 142 can protrude through a first opening 144, a third opening 146, and a fifth opening 148 respectively. The connectors 138, 140, and 142 can be electrical connectors that are part of or attached to the electrical conducting elements. The connectors 138, 140, and 142 can be formed to receive a wire such as a tinned wire. For example, the connectors 138, 140, and 142 can each have an opening that receives the wire and that facilitates the securing of the wires, such as with a set screw or other type of securing device or system. After the set screw has been fastened to secure the wires, the connectors 138, 140, and 142 and the wires can be covered with an insulating material, such as shrink tubing, so as to insulate the bare electrical connections.

The first electrical conducting element 108, the second electrical conducting element 110, and the third electrical conducting element 112 can be configured to extend through the insulating block 102. The electrical conducting elements can be composed or formed of an electrically conducting element, such as a copper rod. A via type opening may be formed in the insulating block 102 to receive an electrical conducting element. The via can be formed prior to the electrical conducting element being inserted into the insulating block 102. Alternatively, the electrical conducting element, such as a copper rod, can be pressed through the insulating block 102 to form the via. The insulating block 102 can be heated to a temperature to ease the formation of a via by pressing the rod through the insulating block 102. The insulating block 102 can further comprise a recessed cavity 150 surrounding the connector 138 and the end of the first electrical conducting element 108. The recessed cavity 150 can be cylindrical in shape and larger than the via that is formed in the insulating block 102 that is to receive the first electrical conducting element 108. The recessed cavity 150 can be designed to receive an insulation material that covers the connector 138 and the end of the first electrical conducting element 108. The insulation material can be a shrink tube or shrink sleeve. The recessed cavity 150 can ensure that no portion of the first electrical conducting element 108 or the connector 138 is exposed at the rear surface 106. The second electrical conducting element 110 and the third electrical conducting element 112 are also depicted as having recessed cavities near the connectors 140 and 142. The recessed cavities can be designed to reduce creepage between the connectors 138, 140, and 142.

The third surface 126 and the sixth surface 128 depict surfaces of the terminal block 100 that are designed to reduce electrical creepage between uninsulated connections of electrical conducting elements. In one example, the third surface 126 and the sixth surface 128 (see FIG. 1F) can comprise a non-linear surface or surface pattern that is not smooth. In one aspect, the non-linear surface pattern may be wavy, curved, have sharp edges, curved edges, or any other pattern that is not smooth or straight, and that provides a circuitous path along the surface. This can be accomplished by making the non-linear pattern in three dimensions such that surface creepage moves in three dimensions along the surface as compared to a linear smooth surface that is two dimensional. The non-linear surface pattern can provide greater creepage distance than a smooth surface that can function to reduce electrical leakage between two uninsulated connections of the electrical conducting elements. By forming the third surface 126 with a non-linear pattern, the distance to the third surface 126 is increased, and therefore a shortest distance along the third surface 126 between two uninsulated connections can be increased, as compared to an example where the third surface 126 has a smooth or flat surface. The increased distance increases the creepage distance, and therefore decreases the potential for electrical leakage current. Alternatively, the third surface 126 and the sixth surface 128 can be made with a linear surface pattern that is substantially smooth. The linear surface pattern may be two dimensional and made adequately long such that the surface distance between two uninsulated connections of electrical conducting elements is sufficient to reduce electrical creepage.

With reference to FIGS. 2A-2F, illustrated is a terminal block assembly 200 in accordance with an example. The terminal block assembly 200 can include a plurality of terminal blocks. For example, terminal block 202 can be one of the plurality of terminal blocks of the terminal block assembly 200. The terminal block 202 can include electrical conducting elements with connectors 238 extending from the rear surface and connectors 250 extending from the front surfaces. The terminal blocks of the terminal block assembly 200 can have all of the same features, components, and capabilities of the terminal block 100 shown in FIGS. 1A-1F, and discussed above. The terminal block assembly 200 can comprise a chassis 204, and the plurality of terminal blocks can be housed in the chassis 204, and particularly within respective slots formed in the chassis 204. The chassis 204 can comprise side plates or sidewalls 206 and 208, a top plate 226, a bottom plate 228, and a back plate 230 that operate together to provide a housing-like structure that supports and removably retains or secures the one or more terminal blocks and the one or more removable barriers. The back plate 230 can be operable with the top plate 226, the bottom plate 228, the first sidewall 206, and the second sidewall 208 of the chassis 204. The back plate 230 can help retain the plurality of terminal blocks and the removable barriers within the chassis 204. The back plate 230 can comprise an opening 244 that facilitates access to the rear surfaces of the plurality of terminal blocks supported in the chassis 204, as well as to the various connectors of the various electrical conducting elements of the plurality of terminal blocks of the terminal block assembly 200. The chassis 204, or at least some portions of the chassis 204, such as the top plate 226 and the sidewalls 206 and 208, can be composed or formed of an insulating material that is the same or different as the insulating material used for the insulating block of the plurality of terminal blocks (e.g., terminal block 202).

The terminal block assembly 200 can comprise a plurality of removable barriers, such as a removable barrier 214, supported by the chassis 204 between adjacent terminal blocks. For example, the removable barrier 214 can be positioned between two adjacent or neighboring terminal blocks. The removable barrier 214 (as well as any others) can be composed or formed of an insulating material that is the same as or different from the insulating material used for the insulating block of the terminal block 202. The terminal block assembly 200 can have a removable barrier supported by the chassis between each pair of terminal blocks (e.g., between adjacent terminal blocks) in the terminal block assembly 200. The removable barriers can electrically insulate the terminal blocks from one another.

The terminal blocks on the far ends of the terminal block assembly 200 (e.g., the first and last terminal blocks) may have connection receivers 210 and 212 respectively. The connection receivers 210 and 212 can be designed to receive a fastener. The connection receivers 210 and 212 can be located in an endmost surface (e.g., the seventh surface 130 of the terminal block 100 of FIG. 1A).

The terminal block assembly 200 can be mounted or otherwise secured to a structure (e.g., a wall, a bulkhead, or another structure as will be recognized by those skilled in the art) by mounting one or more components of the chassis 204 to the structure. In one example, the chassis 204 can be pivotally coupled to the structure, such that the entire terminal black assembly 200 can pivot or rotate relative to the structure. As such, the chassis 204 can further comprise a hinge plate 248 pivotally coupled to the back plate 230 via a hinge 216, which hinge plate 248 can be fastened or otherwise mounted or secured to the structure. The hinge plate 248 can be mounted using fasteners inserted through the openings 218 in the hinge plate 248, as well as other openings not depicted in FIG. 2A. Other devices and securing methods can be employed to secure the chassis 204, and the overall terminal block assembly 200 to the structure.

The hinge 216 can facilitate a portion of the chassis 204, namely, the top plate 226, the bottom plate 228, the sidewalls 206 and 208, and the back plate 230, as well as the plurality of terminal blocks and removable barriers supported by the chassis 204, to pivot (e.g., downward) relative to the structure into an access position. The pivoting motion provided by the hinge 216, and the placement of the terminal block assembly 200 in the access position, can expose a rear of the terminal block assembly 200 and allow access to the rear surfaces of the plurality of terminal blocks and the connectors of the electrical conducting elements on the rear surfaces of the plurality of the terminal blocks, respectively. The particular placement or location of the hinge 216 is not intended to be limiting in any way. Indeed, the chassis 204 can comprise a hinge about any side or surface to allow the terminal block assembly to pivot along any desired axis so as to expose the rear of the terminal block assembly 200 and the connectors of the terminal block assembly 200.

The terminal block assembly 200 allows the present technology to be scalable. For example, the terminal block assembly 200 can have a plurality (e.g., 10, 12, 16, 20) slots for terminal blocks, but every slot does not need to be filled with a terminal block. Therefore, terminal blocks can be added to the terminal block assembly 200 as needed. It should be appreciated that a terminal block assembly can be built with any number of terminal block slots. If every slot is being used in the terminal block assembly 200, then a second terminal block assembly may be added to fulfill some application requirements.

The terminal block assembly 200, and particularly the chassis 204, can further comprise a retention plate 220 secured in place by fasteners 222 and 224 that function to fasten the retention plate 220 to one or more of the plurality of terminal blocks supported by the chassis. The retention plate 220 can be attached after the terminal blocks and removable partitions or barriers have been positioned or placed within the chassis 204. The removable partitions or barriers can be referred to as partition barriers or intermediate insulated dividers. The terminal blocks and removable barriers can be placed between, the top plate 226 and the bottom plate 228 of the chassis 204. A distance between the top plate 226 and the bottom plate 228 can be designed to be the same or slightly larger than the height of the terminal blocks and removable barriers, such that the terminal blocks and removable partitions can be held in place between the top plate 226 and the bottom plate 228 with friction. The retention plate 220 may further secure the terminal blocks and removable barriers to the chassis 204 by fastening the retention plate 220 to the terminal block having connection receiver 210 and the terminal block having connection receiver 212, using the fasteners 222 and 224. In one example, the removable barriers can increase the creepage distance between connectors of different terminal blocks in the same terminal block assembly 200. By placing the removable barrier 214 between two uninsulated connections, the creepage distance increases. In such an example, the creepage distance can start at a first uninsulated connection, then travel up a first surface of the removable barrier 214 and the down a second surface of the removable barrier 214, and then to the second uninsulated connection. The creepage distance traveling up one surface and down a second surface of the removable barrier 214 is therefore increased as compared to an example without a removable barrier between the two uninsulated connections. In one example, the creepage distance between two terminal blocks located on either side of a removable barrier can be designed to withstand two times the working voltage that is being passed through the terminal block. For example, the creepage distance between two terminal blocks located on either side of a removable barrier can be increased, such that the removable barrier allows a working voltage of the two terminal blocks to be at least two times the working voltage (can include greater than two times the working voltage), as compared to the working voltage of an example of two terminal blocks without a removable barrier.

The terminal block assembly 200 can further comprise a coupling device 240 that functions to releasably engage the structure to which the terminal block assembly 200 is mounted to facilitate the securing of the terminal block assembly 200 in an upright, operating position, and to facilitate rotating of the terminal block assembly 200 to a downward, access position. The coupling device 240 operates with the hinge 216 to permit the terminal block assembly 200 to pivot or rotate relative to the structure to which it is mounted to provide access to the various connectors of the electrical coupling elements of the terminal blocks of the terminal block assembly 200. In one example, the coupling device can comprise an actuating mechanism supported (e.g., mounted) to the top plate 226 of the chassis 204, and a spring-loaded moveable latch (e.g., a hook 232) operable to be actuated by the actuating mechanism, such as via a lever of the actuating mechanism, and to interface with and engage the structure (or a securing device or object supported on the structure), thereby securing the terminal block assembly 200 in the upright, operating position and preventing rotation of the terminal block assembly 200 relative to the structure. The coupling device 240 shown is not intended to be limiting in any way. Indeed, other types of coupling mechanisms can be used that operate to releasably secure and engage the support structure to which the terminal block assembly 200 is mounted.

In operation, and with reference to FIGS. 2G-2J and continued reference to FIGS. 2A-2F, the terminal block assembly 200 can be pivotally mounted to a structure, such as structure 242, for use in a variety of applications. In some examples, the structure 242 can comprise a wall, a bulkhead, or any other suitable structure suitable for supporting the terminal block assembly 200 for its intended purpose. As discussed above, the terminal block assembly 200 can be pivotally mounted to the structure 242 by mounting the hinge plate 248 of the chassis 204 to the structure 242, which hinge plate 248 can be rotatably coupled to one or more other components of the chassis 204, such as the back plate of the chassis 204. In one aspect, the terminal block assembly 200 can be supported in an upright, operating position (see FIG. 2G) relative to the structure 242. The coupling device 240 operates to secure the terminal block assembly 200 in the upright, operating position via the latch (e.g., hook 232), which extends through an opening 234 formed in the structure 242 and latches (e.g., hooks) to the structure 242. In another aspect, the actuating mechanism of the coupling device 240 can be actuated to overcome the spring biasing force of the latch, whereby the latch (the hook 232 in this example) is displaced or moved to effectuate the release or disengagement of the latch from the structure (or securing device). With the latch disengaged, the terminal block assembly 200 can be caused to rotate or pivot relative to the structure into the downward, access position (see FIG. 2H) via the hinge 216. When in the downward, access position, a user may access the connectors of the plurality of terminal blocks without having to go to the other side of the structure 242. For example, the structure 242 may be large and difficult for a user to access the other side of the structure 242. The structure 242 may be a wall in a first room and a user may have access to the first room and not have access to a second room adjacent to the first room on the other side of the structure 242. Wires coupled to the terminal block assembly 200 can be routed through the opening 236 and can be caused to connect to the electrical conducting elements of the plurality of terminal blocks extending from the rear surfaces.

Figure 2A:
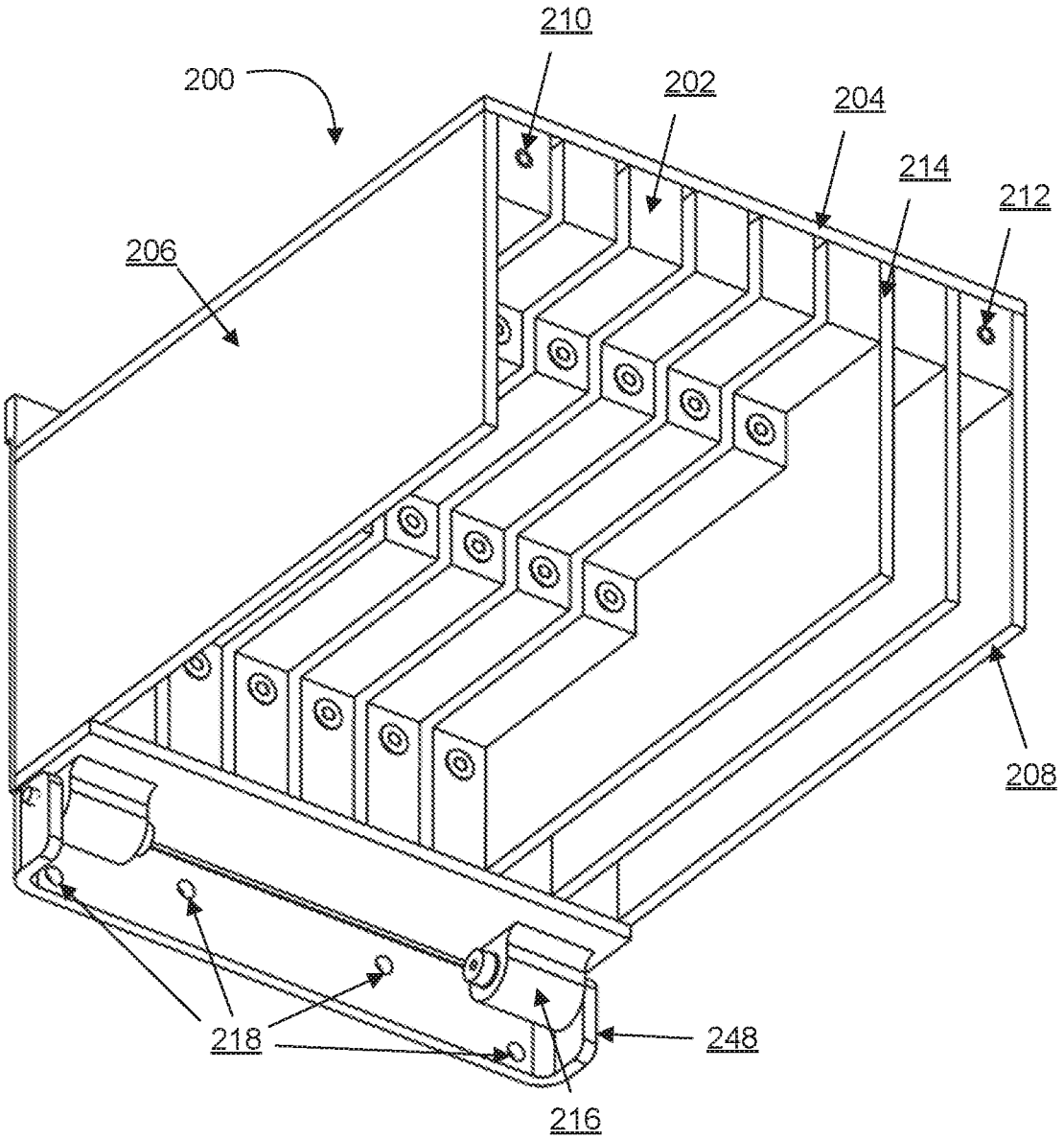
FIG. 2A illustrates an isometric view of a terminal block assembly comprising a plurality of terminal blocks as shown in FIG. 1A, according to an example of the present technology.
Figure 2B:
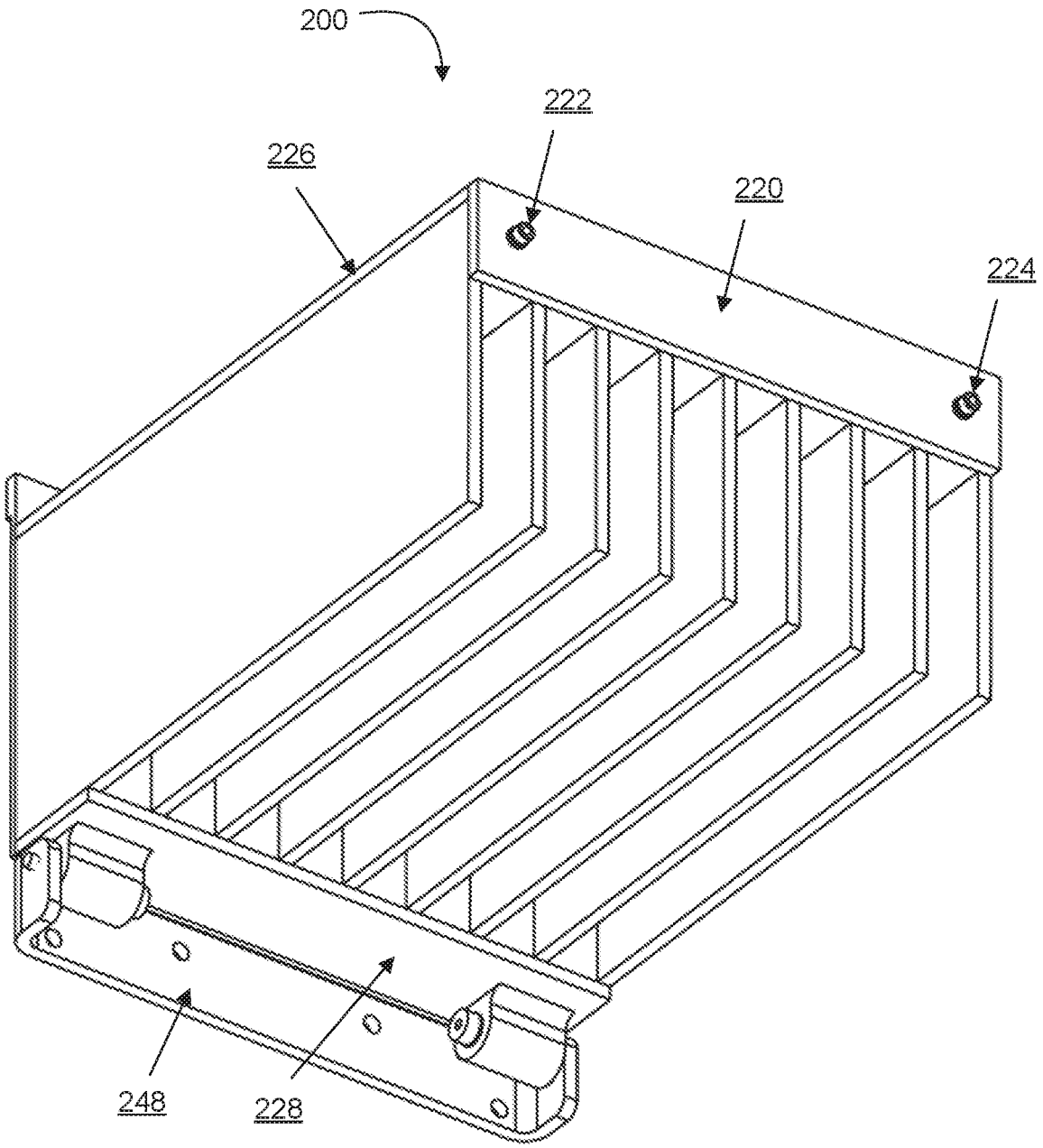
FIG. 2B illustrates an isometric view of the terminal block assembly of FIG. 2A.
Figure 2C:
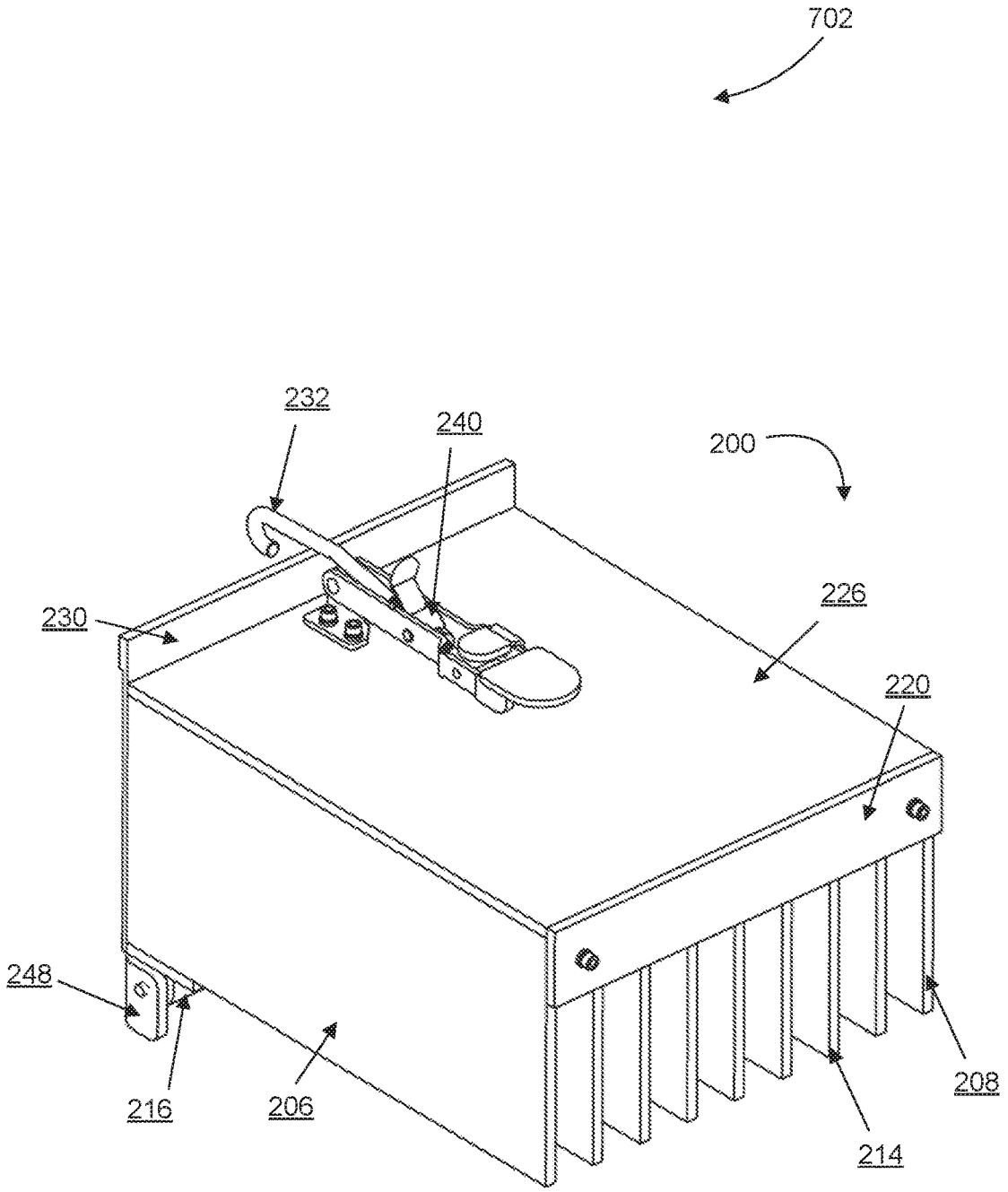
FIG. 2C illustrates an isometric front view of the terminal block assembly of FIG. 2A, depicting a coupling device.
Figure 2D:
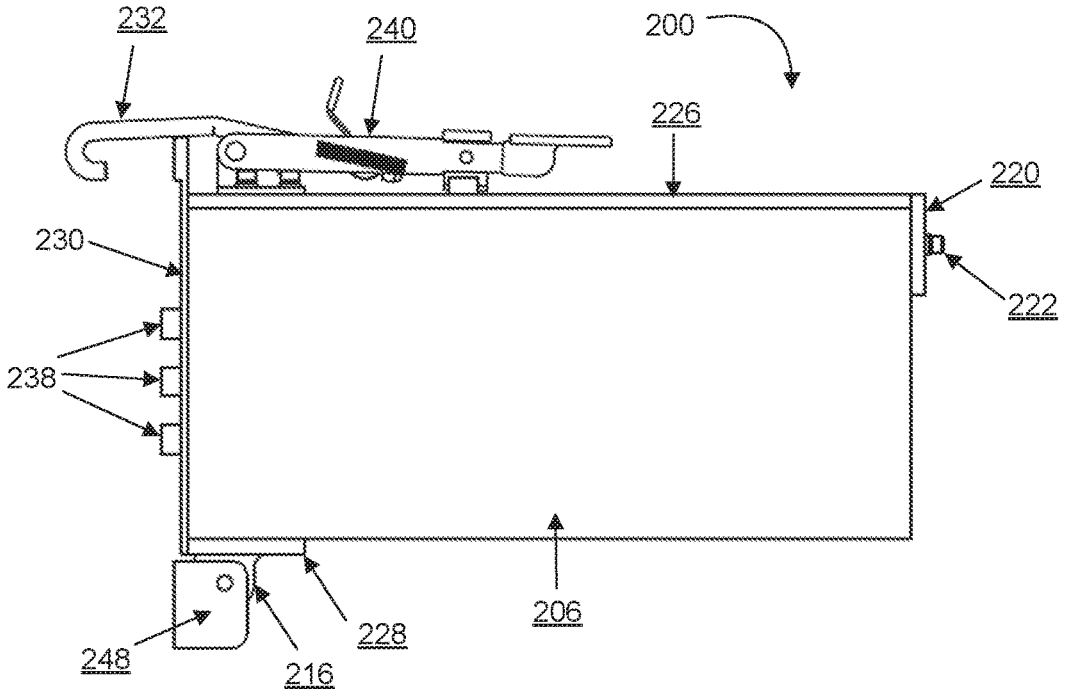
FIG. 2D illustrates a side view of the terminal block assembly of FIG. 2A.
Figure 2E:
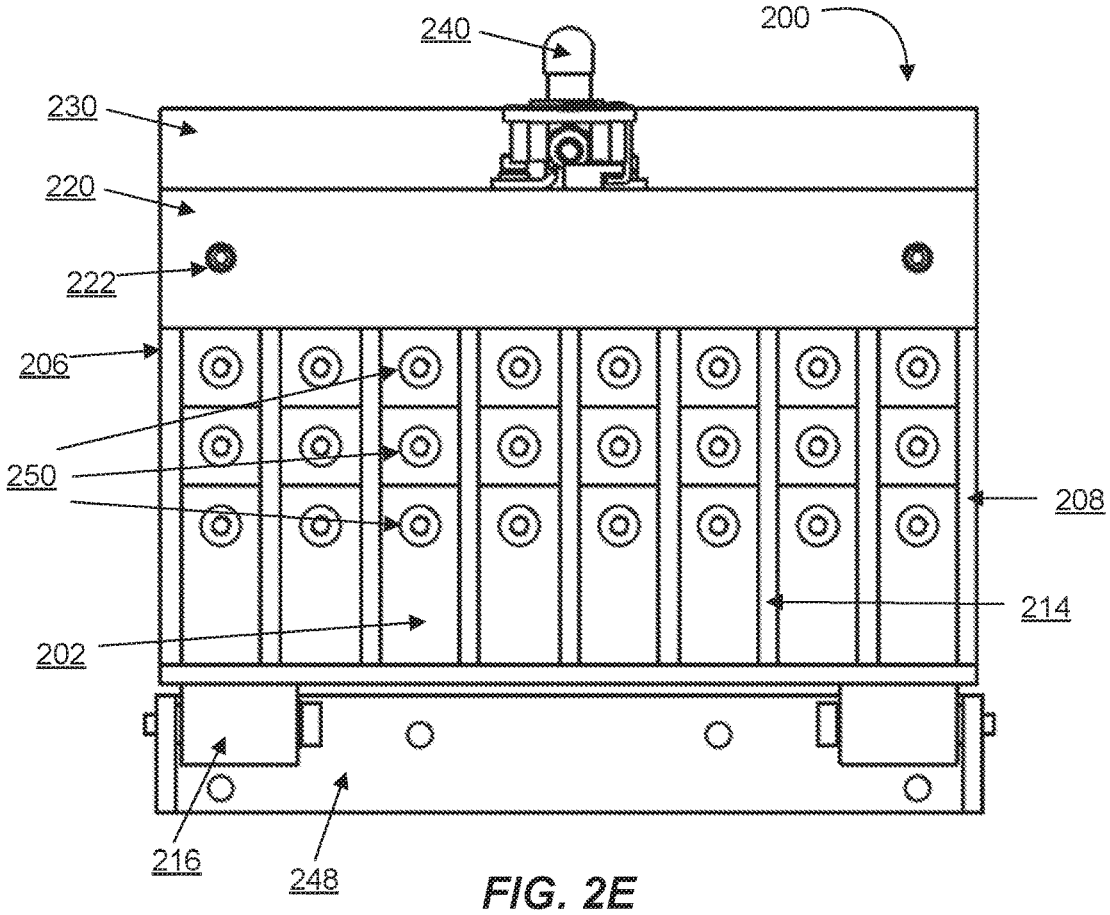
FIG. 2E illustrates a front view of the terminal block assembly of FIG. 2A.
Figure 2F:
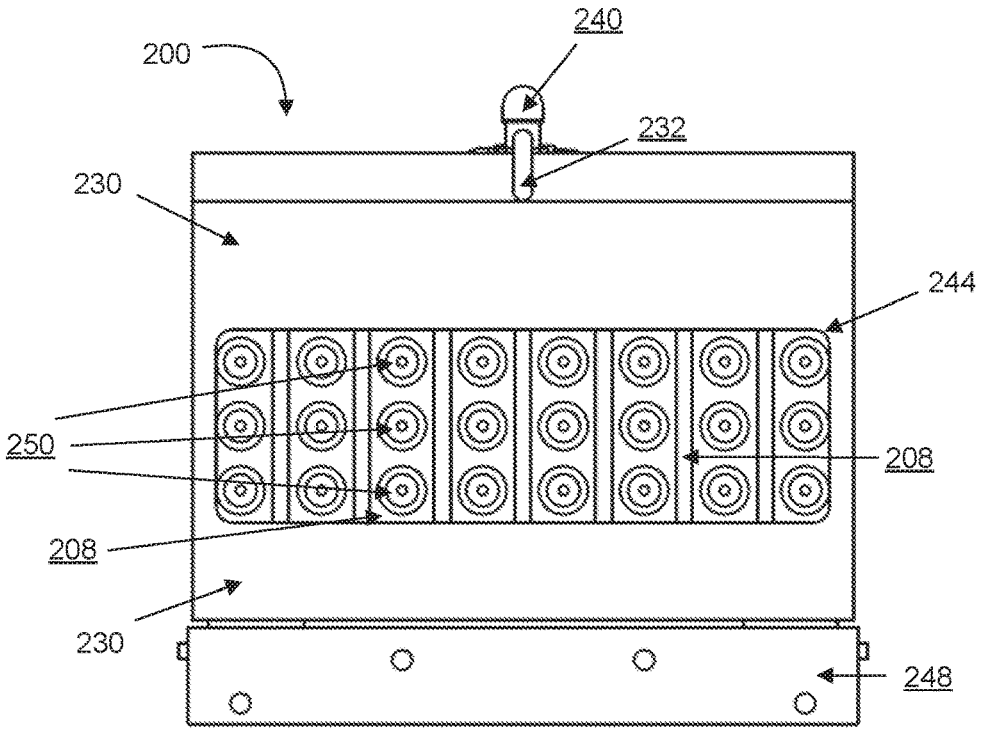
FIG. 2F illustrates a back or rear view of the terminal block assembly of FIG. 2.
Figure 2G:
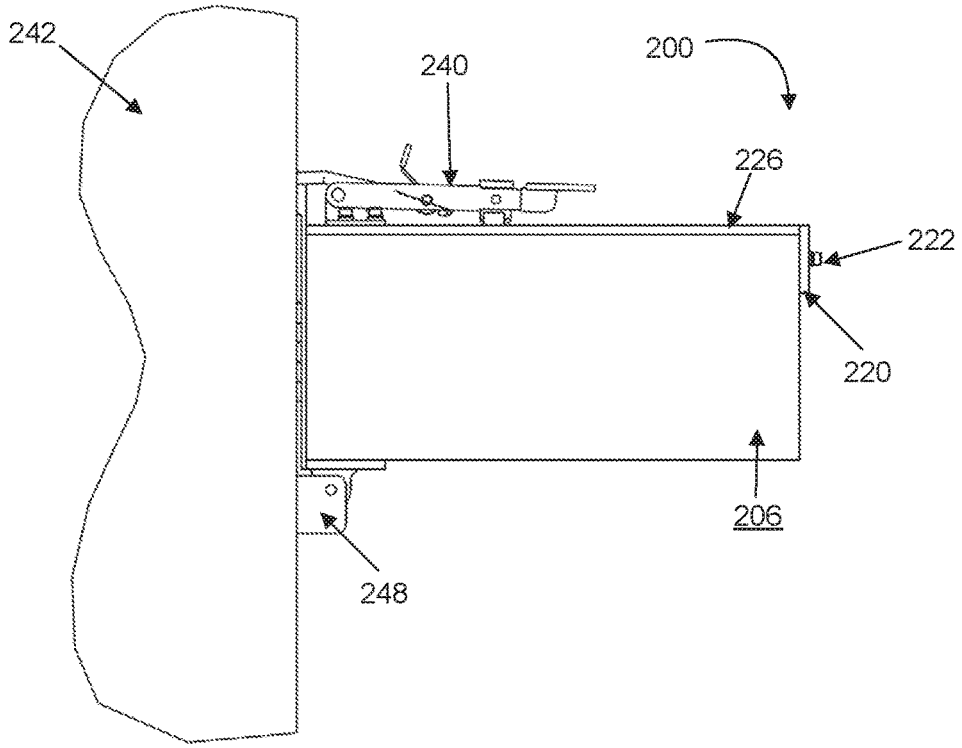
FIG. 2G illustrates a side view of the terminal block assembly of FIG. 2A as mounted to an exemplary structure, according to an example of the present technology.
Figure 2H:
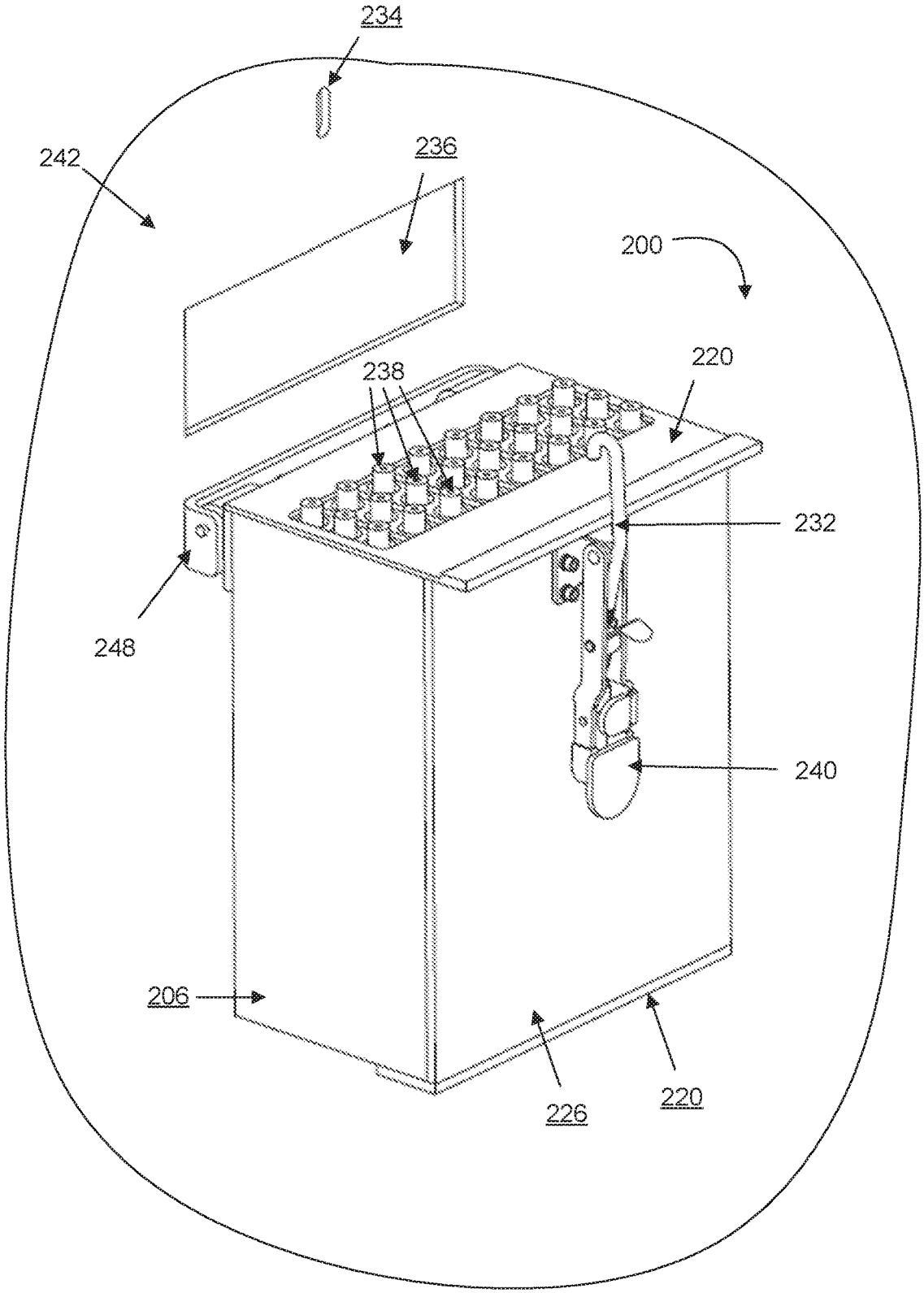
FIG. 2H illustrates an isometric view of the terminal block assembly of FIG. 2A as mounted to a structure according to an example of the present technology.
Figure 2I:
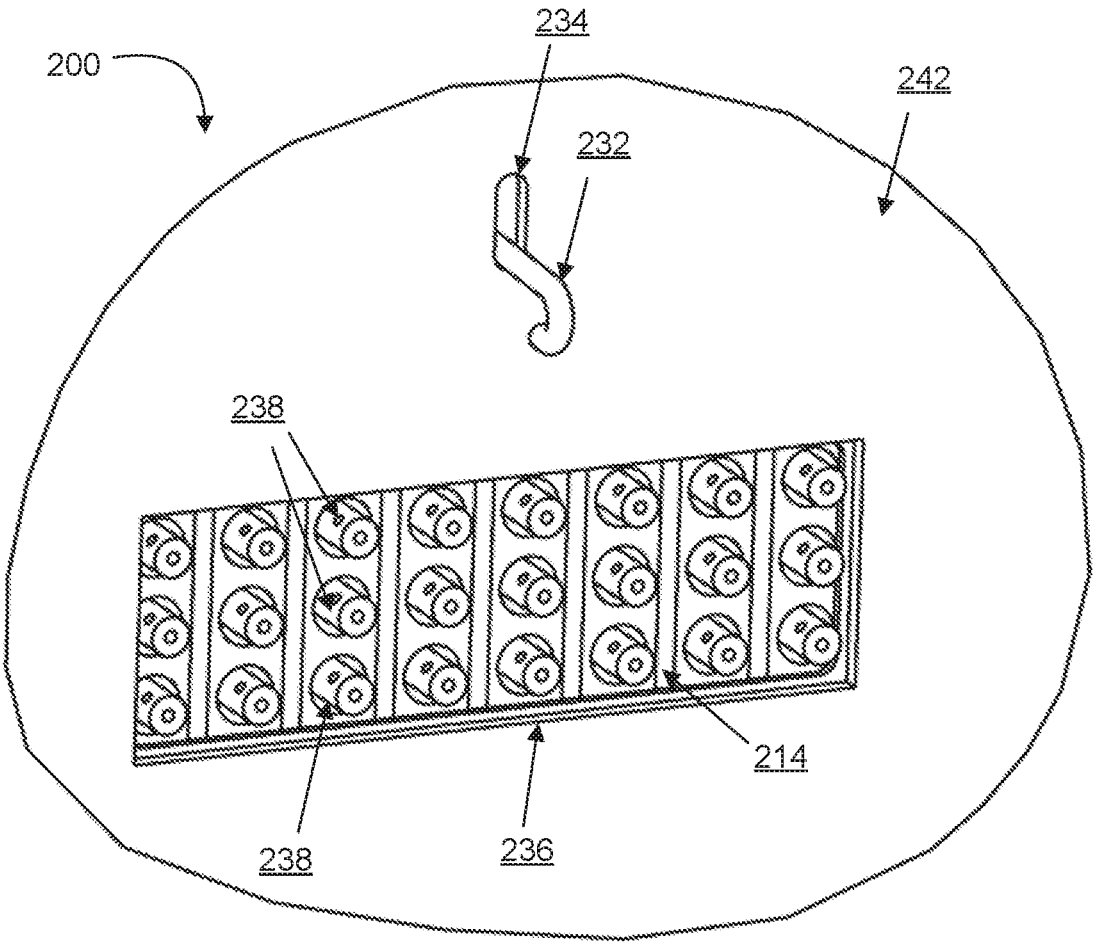
FIG. 2I illustrates partial detailed view of the back or rear of the terminal block assembly of FIG. 2A, depicting a back plate of a chassis of the assembly, with various openings in the structure.
Figure 2J:
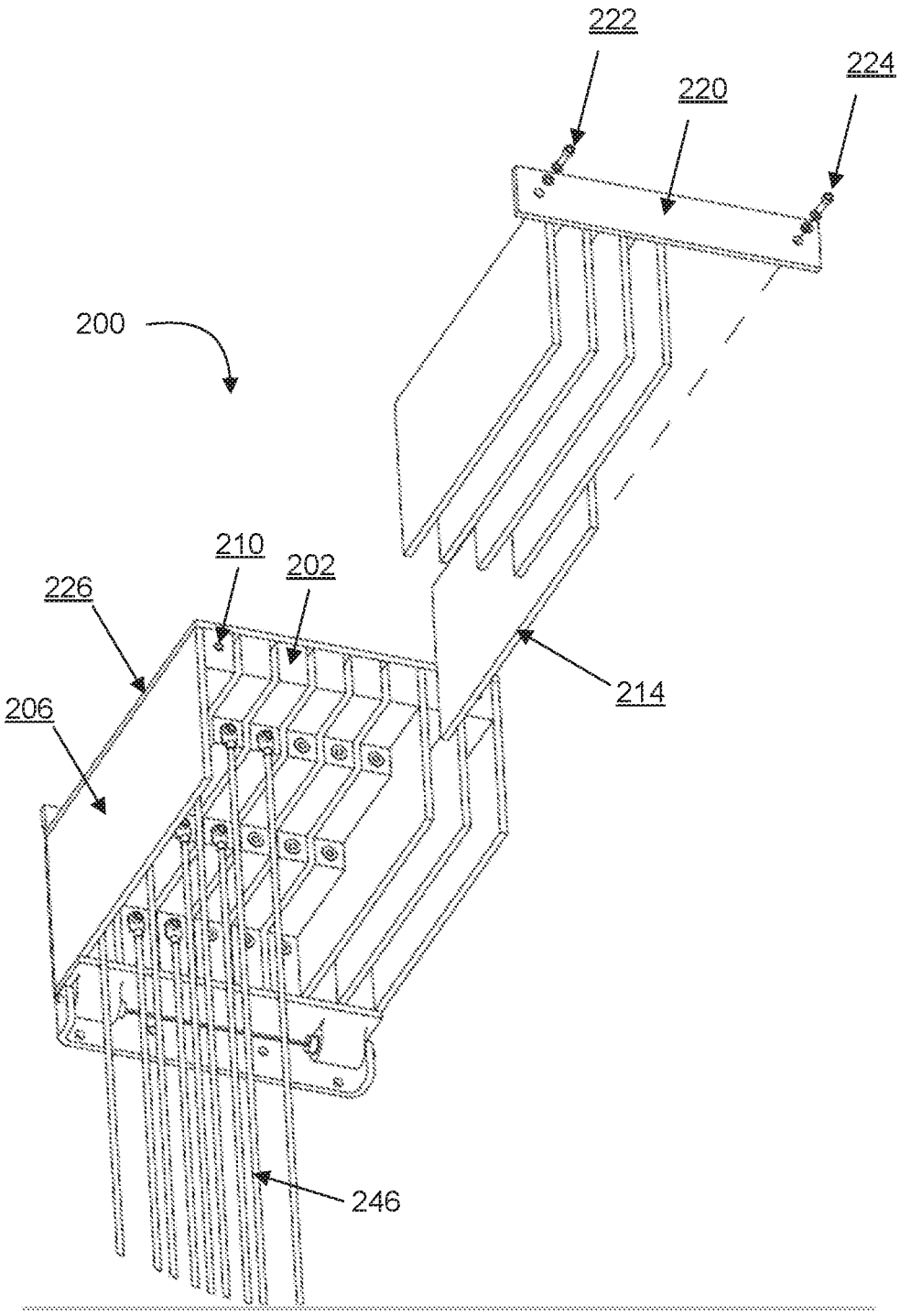
FIG. 2J illustrates an isometric view of the terminal block assembly of FIG. 2A depicted as having wires connected to connectors of the terminal blocks.

FIG. 2J illustrates a plurality of removable barriers 214, where some of the removable barriers 214 have been placed in between terminal blocks in the terminal block assembly 200 and some of the removable barrier 214 are in the process of being inserted into the terminal block assembly 200. FIG. 2J further illustrates the terminal block assembly 200 as having various wires 246 connected to the various connectors of the plurality of terminal blocks. The connectors may be uninsulated connectors such as connectors 132, 134, and 136 in FIG. 1B.

Figure 3:
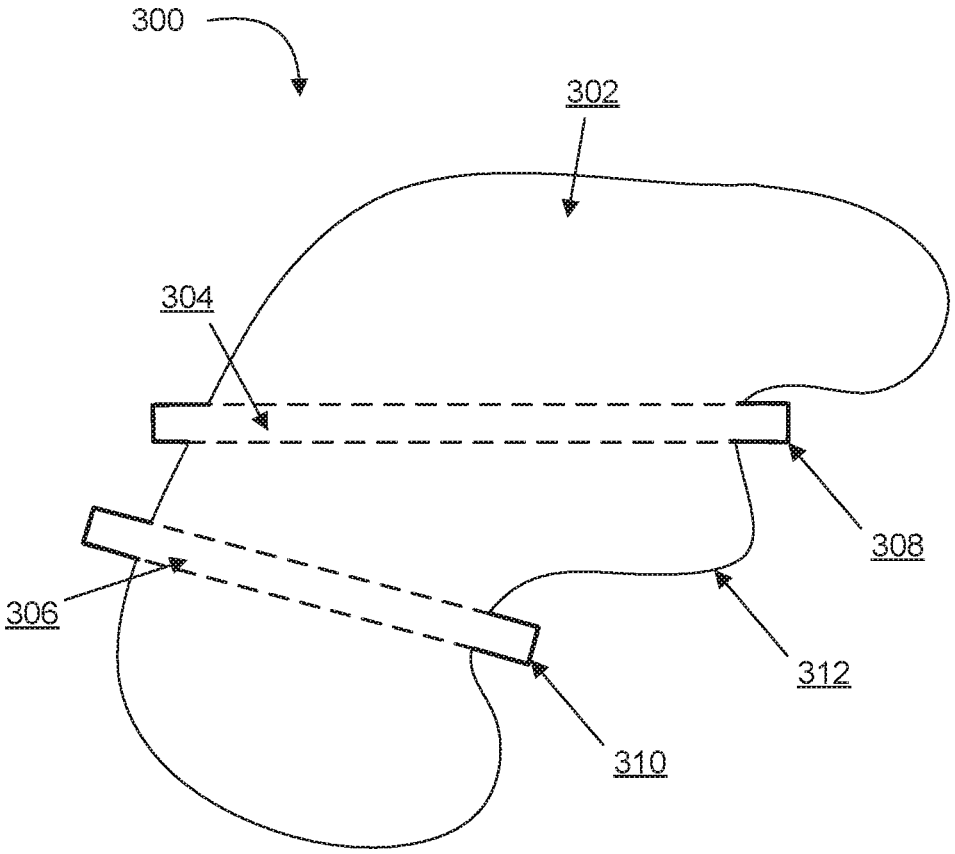
FIG. 3 illustrates a side view of a terminal block according to an example of the present technology.

With reference to FIG. 3 the present disclosure sets forth a terminal block 300 in accordance with one example. The terminal block 300 depicts a shape for an insulating block 302 that does not have surfaces with parallel lines nor surfaces that join one another with perpendicular angles. The insulating block 302 includes a first electrical conducting element 304 and a second electrical conducting element 306 that are not parallel to one another. The first electrical conducting element 304 can include a connector 308 and the second electrical conducting element 306 can include a connector 310. The connectors 308 and 310 are separated by a surface 312. The surface 312 is an irregular shape that increases the distance between the connectors 308 and 310 as compared to a surface that is flat or substantially smooth. The increased distance between the connectors 308 and 310 increases the creepage distance and therefore decreases the potential for electrical leakage currents. The surface 312 is formed, such that the connectors 308 and 310 do not have line of sight to one another. By removing a line of sight between the connectors 308 and 310, the clearance between the connectors 308 and 310 is increased and the potential for an electrical arc is decreased.

Figure 4:
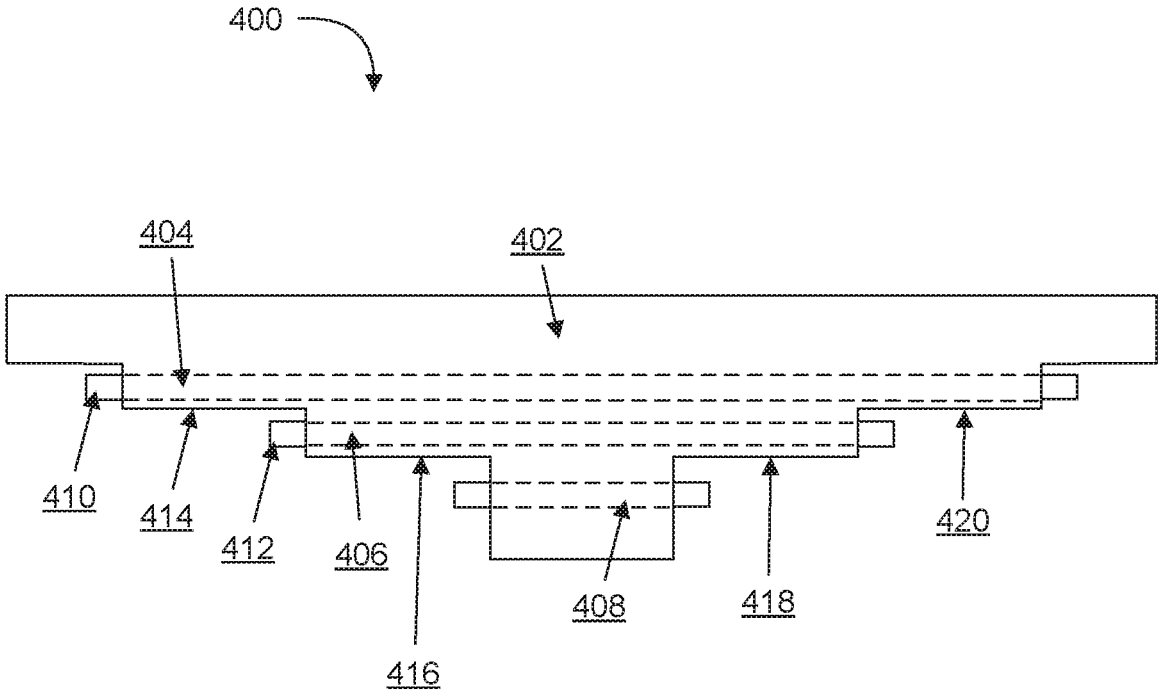
FIG. 4 illustrates a side view of a terminal block according to an example of the present technology.

With reference to FIG. 4 the present disclosure sets forth a terminal block 400 in accordance with one example. The terminal block 400 can include an insulating block 402 that can be formed with a shape with a stair step pattern that is mirrored, such that both the front side and the rear side of the terminal block 400 has a stair step pattern. The insulating block 402 can include a first electrical conducting element 404, a second electrical conducting element 406, and a third electrical conducting element 408. The first electrical conducting element 404 can have a connector 410 that is an uninsulated connector. The second electrical conducting element 406 can have a connector 412 that is an uninsulated connector. The surface 414 can be designed with a non-linear surface pattern to increase a distance between the connectors 410 and 412 as compared to the connectors 410 and 412 extending from the same surface that is linear or substantially smooth. The increased distance between the connectors 410 and 412 due to a non-linear surface pattern increases the creepage distance, and therefore decreases the potential for electrical leakage current. The surface 414 is formed such that the connectors 410 and 412 do not have line of sight to one another. By removing a line of sight between the connectors 410 and 412, the clearance between the connectors 410 and 412 is increased and the potential for an electrical arc is decreased. Surfaces 416, 418, and 420 also increase creepage and clearance distances between the connectors of the first electrical conducting element 404, the second electrical conducting element 406, and the third electrical conducting element 408.

Figure 5:
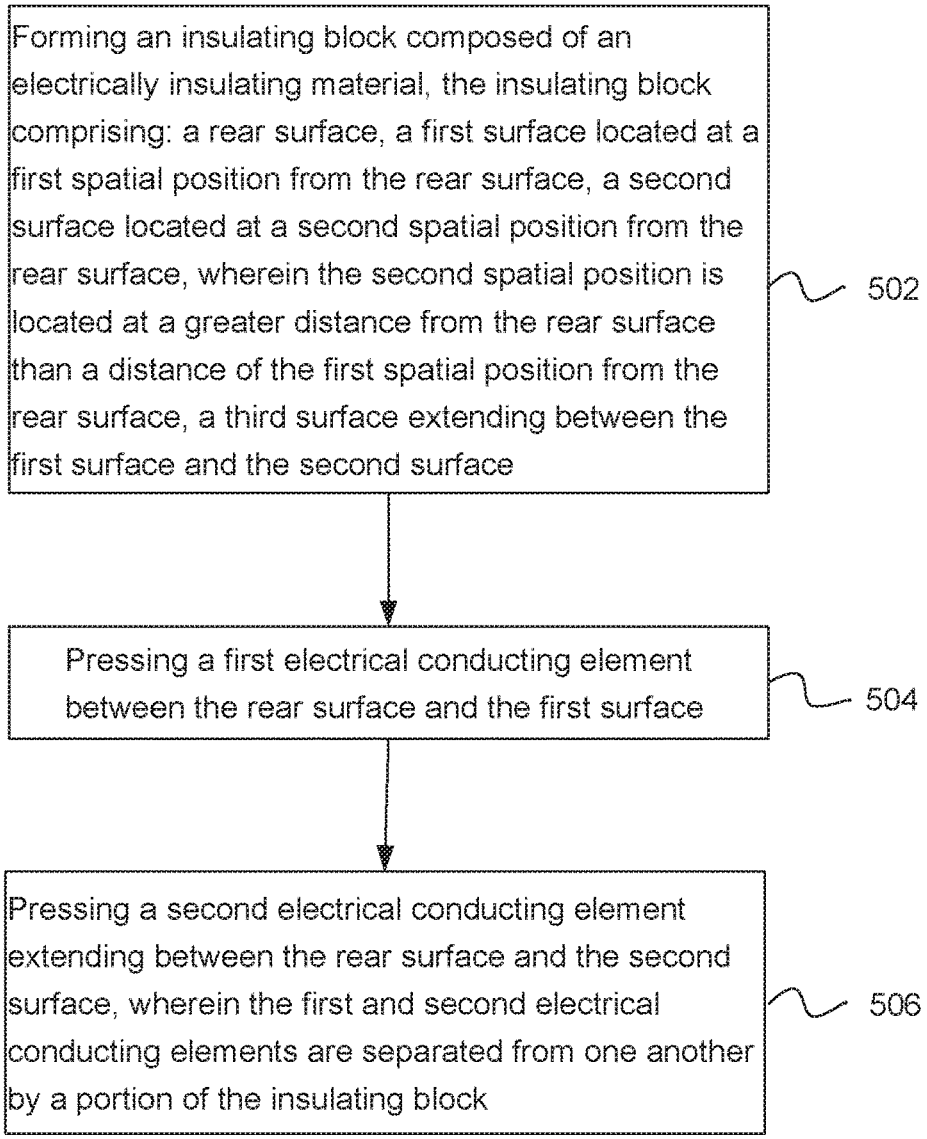
FIG. 5 illustrates a flowchart of an example method 400 for configuring a terminal block according to an example of the present technology.

FIG. 5 is a flowchart of an example method 500 for configuring a terminal block according to an example of the present technology. The can include forming 502 an insulating block composed of an electrically insulating material. The insulating block can comprise a rear surface, a first surface located at a first spatial position from the rear surface, a second surface located at a second spatial position from the rear surface, wherein the second spatial position is located at a greater distance from the rear surface than a distance of the first spatial position from the rear surface, a third surface extending between the first surface and the second surface. The method can further include pressing 504 a first electrical conducting element between the rear surface and the first surface. The method can further include pressing 506*a* second electrical conducting element extending between the rear surface and the second surface, wherein the first and second electrical conducting elements are separated from one another by a portion of the insulating block. The method can further include, forming the first surface and the second surface to be parallel to one another, and forming the third surface to be perpendicular to the first surface and the second surface. The method can further include, forming the third surface with a non-linear surface pattern that is not smooth. The method can further include, forming the third surface with a linear surface pattern that is substantially smooth.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Although the disclosure may not expressly disclose that some embodiments or features described herein may be combined with other embodiments or features described herein, this disclosure should be read to describe any such combinations that would be practicable by one of ordinary skill in the art. The use of "or" in this disclosure should be understood to mean non-exclusive or, i.e., "and/or," unless otherwise indicated herein.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A terminal block comprising:

an insulating block composed of an electrically insulating material, the insulating block comprising:

at least one surface formed to fit within a slot of a chassis designed to house a plurality of terminal blocks;

a first via extending between a first and second opening in the insulating block;

a second via extending between a third and fourth opening in the insulating block, wherein a distance between the first and second openings is less than a distance between the third and fourth openings;

a first electrical conducting element extending between the first and second openings; and a second electrical conducting element extending between the third and fourth openings, wherein the first and second electrical conducting elements are separated from one another by a portion of the insulating block.

2. The terminal block of claim 1, further comprising:

a third via extending between a fifth and sixth opening in the insulating block, wherein a distance between the fifth and sixth openings is less than a distance between the first and second openings;

a third electrical conducting element extending between the fifth and sixth openings.

3. The terminal block of claim 1, wherein the second opening and the fourth opening are separated by a separating surface of the insulating block that is not parallel to a length of the first or second electrical conducting element.

4. The terminal block of claim 3, wherein the separating surface of the insulating block has a non-linear surface pattern to facilitate creepage in three dimensions along the separating surface.

5. The terminal block of claim 3, wherein the separating surface of the insulating block has a linear surface pattern that is substantially smooth.

6. The terminal block of claim 1, wherein the first electrical conducting element and the second electrical conducting element are selected from the group of elements consisting of: a rod, a wire, a collection of wires, or any other electrically conducting device or structure.

7. The terminal block of claim 1, wherein the first opening and the third opening are on a first surface of the insulating block and contain lugged connections to the first electrical conducting element and the second electrical conducting element; and wherein the second opening and the fourth opening are on a second surface of the insulating block and contain tinned wire connections to the first electrical conducting element and the second electrical conducting element.

8. The terminal block of claim 7, wherein first surface and the second surface are parallel.

9. The terminal block of claim 1, wherein first electrical conducting element and the second electrical conducting element are a set of conducting elements housed by the insulating block and the insulating block is separated from a second insulating block by a removable partition barrier that electrically insulate the set of conducting elements of the insulating block from a second set of conducting elements of the second insulating block.

10. A terminal block comprising:

an insulating block composed of an electrically insulating material, the insulating block comprising:

at least one surface formed to fit within a slot of a chassis designed to house a plurality of terminal blocks;

a rear surface;

a first surface located at a first spatial position from the rear surface;

a second surface located at a second spatial position from the rear surface, wherein the second spatial position is located at a greater distance from the rear surface than a distance of the first spatial position from the rear surface;

a third surface extending between the first surface and the second surface;

a first electrical conducting element extending between the rear surface and the first surface; and a second electrical conducting element extending between the rear surface and the second surface, wherein the first and second electrical conducting elements are separated from one another by a portion of the insulating block.

11. The terminal block of claim 10, wherein the first surface and the second surface are parallel and the third surface is perpendicular to the first surface and the second surface.

12. The terminal block of claim 10, wherein the third surface has a non-linear surface pattern to facilitate creepage in three dimensions along the separating surface.

13. The terminal block of claim 10, wherein the third surface has a linear surface that is substantially smooth.

14. The terminal block of claim 10, wherein the first electrical conducting element and the second electrical conducting element are selected from the group of elements consisting of: a rod, a wire, a collection of wires, or any other electrically conducting device or structure.

15. The terminal block of claim 10, wherein the first electrical conducting element and the second electrical conducting element have tinned wired connections extending from the rear surface and lugged connections extending from the first surface and the second surface.

16. The terminal block of claim 10, wherein the first electrical conducting element and the second electrical conducting element are a set of conducting elements housed by the insulating block and the insulating block is separated from a second insulating block by a removable partition barrier that electrically insulate the set of conducting elements of the insulating block from a second set of conducting elements of the second insulating block.

17. A terminal block assembly comprising:

a chassis;

a plurality of terminal blocks releasably supported within the chassis, each of the plurality of terminal blocks comprising:

an insulating block composed of an electrically insulating material, the insulating block comprising:

a rear surface;

a first surface located at a first spatial position from the rear surface;

a second surface located at a second spatial position from the rear surface, wherein the second spatial position is located at a greater distance from the rear surface than a distance of the first spatial position from the rear surface;

a third surface extending between the first surface and the second surface;

a first electrical conducting element extending between the rear surface and the first surface; and a second electrical conducting element extending between the rear surface and the second surface, wherein the first and second electrical conducting elements are separated from one another by a portion of the insulating block;

a plurality of removable partition barriers that electrically insulate the plurality of terminal blocks from one another, each being supported by the chassis and disposed between adjacent terminal blocks.

18. The terminal block assembly of claim 17, wherein the chassis further comprises a hinge operable to pivotally mount the terminal block assembly to a structure, wherein the hinge facilitates rotation of the terminal block assembly relative to the structure between an upright, operating position and a downward, access position.

19. The terminal block assembly of claim 17, wherein the chassis further comprises:

a retention plate configured to attach to the chassis and retain the insulating block by applying pressure to a fourth surface of the insulating block wherein the fourth surface is at a third spatial position from the rear surface, wherein the third spatial position is located at a greater distance from the rear surface than a distance of the second spatial position from the rear surface.

20. The terminal block assembly of claim 17, wherein the first surface and the second surface are parallel and the third surface is perpendicular to the first surface and the second surface.

21. The terminal block assembly of claim 17, wherein the third surface has a non-linear surface pattern to facilitate creepage in three dimensions along the separating surface.

22. The terminal block assembly of claim 17, wherein the third surface has a linear surface pattern that is substantially smooth.

23. The terminal block assembly of claim 17, wherein the first electrical conducting element and the second electrical conducting element are selected from the group of elements consisting of a rod, a wire, a collection of wires, or any other electrically conducting device or structure.

24. The terminal block assembly of claim 17, wherein the first electrical conducting element and the second electrical conducting element have tinned wired connections extending from the rear surface and lugged connections extending from the first surface and the second surface.

25. The terminal block assembly of claim 17, further comprising a coupling device supported about the chassis, the coupling device comprising a latch operable to releasably secure to a structure, and to facilitate rotation of the terminal block assembly relative to the structure.

26. A method for configuring a terminal block, comprising:

forming an insulating block composed of an electrically insulating material, the insulating block comprising:

at least one surface formed to fit within a slot of a chassis formed from an insulating material designed to house a plurality of terminal blocks;

a rear surface;

a first surface located at a first spatial position from the rear surface;

a second surface located at a second spatial position from the rear surface, wherein the second spatial position is located at a greater distance from the rear surface than a distance of the first spatial position from the rear surface;

a third surface extending between the first surface and the second surface;

pressing a first electrical conducting element between the rear surface and the first surface; and pressing a second electrical conducting element extending between the rear surface and the second surface, wherein the first and second electrical conducting elements are separated from one another by a portion of the insulating block.

27. The method of claim 26, wherein the first surface and the second surface are formed parallel and the third surface is formed perpendicular to the first surface and the second surface.

28. The method of claim 26, wherein the third surface is formed with a non-linear surface pattern to facilitate creepage in three dimensions along the separating surface.

29. The method of claim 26, wherein the third surface is formed with a linear surface pattern that is substantially smooth.

* * * * *